US008899497B2

(12) United States Patent
Gorny

(10) Patent No.: US 8,899,497 B2
(45) Date of Patent: Dec. 2, 2014

(54) SPRINKLER WITH REPELLING MAGNETS

(75) Inventor: Moshe Gorny, Kibbutz Naan (IL)

(73) Assignee: Naandan Jain Irrigation C.S. Ltd., Kibbutz Na'an (IL)

( * ) Notice: Subject to any disclaimer, the term of this patent is extended or adjusted under 35 U.S.C. 154(b) by 236 days.

(21) Appl. No.: 13/476,624

(22) Filed: May 21, 2012

(65) Prior Publication Data

US 2012/0318889 A1 Dec. 20, 2012

Related U.S. Application Data

(60) Provisional application No. 61/498,715, filed on Jun. 20, 2011.

(51) Int. Cl.

| | |
|---|---|
| ***B05B 3/06*** | (2006.01) |
| ***B05B 3/04*** | (2006.01) |
| ***B05B 3/08*** | (2006.01) |
| ***B05B 3/16*** | (2006.01) |
| *B05B 15/06* | (2006.01) |

(52) U.S. Cl.
CPC .. *B05B 3/06* (2013.01); *B05B 15/06* (2013.01)
USPC ..... 239/252; 239/251; 239/222.17; 239/231; 239/232; 239/242

(58) Field of Classification Search
USPC ..... 239/222.17, 230–233, 242, 244, 251, 239/255, 252
See application file for complete search history.

(56) References Cited

U.S. PATENT DOCUMENTS

| | | | | |
|---|---|---|---|---|
| 3,791,585 A | | 2/1974 | Warren | |
| 4,055,304 A | * | 10/1977 | Munson | 239/230 |
| 5,236,126 A | * | 8/1993 | Sawade et al. | 239/252 |
| 5,950,927 A | * | 9/1999 | Elliott et al. | 239/222.21 |
| 6,016,972 A | | 1/2000 | Kantor et al. | |
| 6,698,629 B2 | * | 3/2004 | Taylor-McCune | 222/571 |
| 7,111,796 B2 | | 9/2006 | Olson | |
| 7,562,833 B2 | | 7/2009 | Perkins et al. | |
| 2007/0009535 A1 | | 1/2007 | Sikic | |
| 2011/0114755 A1 | | 5/2011 | Katzman et al. | |
| 2012/0318888 A1 | | 12/2012 | Gandin | |

FOREIGN PATENT DOCUMENTS

| | | | | |
|---|---|---|---|---|
| WO | WO 2010001392 A1 | * | 1/2010 | B05B 3/04 |
| WO | 2010/016053 A1 | | 2/2010 | |
| WO | 2012/176185 A1 | | 12/2012 | |
| WO | 2012/176186 A1 | | 12/2012 | |

OTHER PUBLICATIONS

An International Search Report and a Written Opinion both dated Sep. 5, 2012, which issued during the prosecution of Applicant's PCT/IL2012/000199

An International Search Report and a Written Opinion both dated Aug. 31, 2012 which issued during the prosecution of Applicant's PCT/IL2012/000198.

(Continued)

*Primary Examiner* — Len Tran
*Assistant Examiner* — Thomas Berez
(74) *Attorney, Agent, or Firm* — Sughrue Mion, PLLC

(57) ABSTRACT

A sprinkler including a first portion, a second portion arranged to rotate in reciprocating motion in a plane about a generally vertical axis relative to the first portion, responsive to impingement of a water stream on the second portion, at least a first magnet associated with the first portion and at least a second magnet associated with the second portion, the first and second magnets being magnetized to repel each other when in at least predetermined propinquity during relative rotation thereof in the plane.

6 Claims, 5 Drawing Sheets

(56) References Cited

OTHER PUBLICATIONS

An International Preliminary Report on Patentability dated Dec. 23, 2013, which issued during the prosecution of Applicant's PCT/IL2012/000199.

An International Preliminary Report on Patentability dated Dec. 23, 2013, which issued during the prosecution of Applicant's PCT/IL2012/000198.

An Office Action dated Apr. 10, 2014, which issued during the prosecution of U.S. Appl. No. 13/476,434.

* cited by examiner

SPRINKLER WITH REPELLING MAGNETS

REFERENCE TO RELATED APPLICATIONS

Reference is made to U.S. Provisional Patent Application Ser. No. 61/498,715, filed Jun. 20, 2011 and entitled "SPRINKLER WITH PROPELLING MAGNETS", the disclosure of which is hereby incorporated by reference and priority of which is hereby claimed pursuant to 37 CFR 1.78(a) (4) and (5)(i).

FIELD OF THE INVENTION

The present invention relates to sprinklers generally.

BACKGROUND OF THE INVENTION

The following patent publications are believed to represent the current state of the art:

U.S. Pat. Nos. 6,016,972 & 7,111,796 and U.S. Published Patent Application No. 2007/009535.

SUMMARY OF THE INVENTION

The present invention seeks to provide an improved sprinkler.

There is thus provided in accordance with a preferred embodiment of the present invention a sprinkler including a first portion, a second portion arranged to rotate in reciprocating motion in a plane about a generally vertical axis relative to the first portion, responsive to impingement of a water stream on the second portion, at least a first magnet associated with the first portion and at least a second magnet associated with the second portion, the first and second magnets being magnetized to repel each other when in at least predetermined propinquity during relative rotation thereof in the plane.

Preferably, the sprinkler also includes a spring and the impingement of the water stream on the second portion drives the second portion to rotate in a first direction about the vertical axis relative to the first portion, the spring is operative to urge rotation of the second portion in a second direction about the vertical axis and the first and second magnets cooperate to at least limit impact of the second portion at the end of its rotation in the first direction.

In accordance with a preferred embodiment of the present invention the sprinkler also includes a third portion and the first portion is rotatable relative to the third portion. Additionally, the sprinkler also includes at least a third magnet associated with the first portion and at least a fourth magnet associated with the third portion, the third and fourth magnets being magnetized to repel each other at least generally along the generally vertical axis. In accordance with a preferred embodiment of the present invention the sprinkler also includes at least a fifth magnet associated with the first portion and at least a sixth magnet associated with the second portion, the fifth and sixth magnets being magnetized to repel each other at least generally along the generally vertical axis.

In accordance with a preferred embodiment of the present invention the third and fourth magnets are operative to retain the second portion in an intermediate vertical position along the generally vertical axis relative to the first portion.

In accordance with a preferred embodiment of the present invention the sprinkler also includes at least a first additional magnet associated with the first portion and at least a second additional magnet associated with the second portion, the first and second additional magnets being magnetized to repel each other at least generally along the generally vertical axis.

Preferably, the first portion includes a water outlet arranged to provide the water stream. Additionally or alternatively, the second portion includes a water stream deflector.

In accordance with a preferred embodiment of the present invention the first portion is a non-fixed portion.

BRIEF DESCRIPTION OF THE DRAWINGS

The present invention will be understood and appreciated from the following detailed description, taken in conjunction with the drawings in which.

DETAILED DESCRIPTION OF A PREFERRED EMBODIMENT

Figure 1:
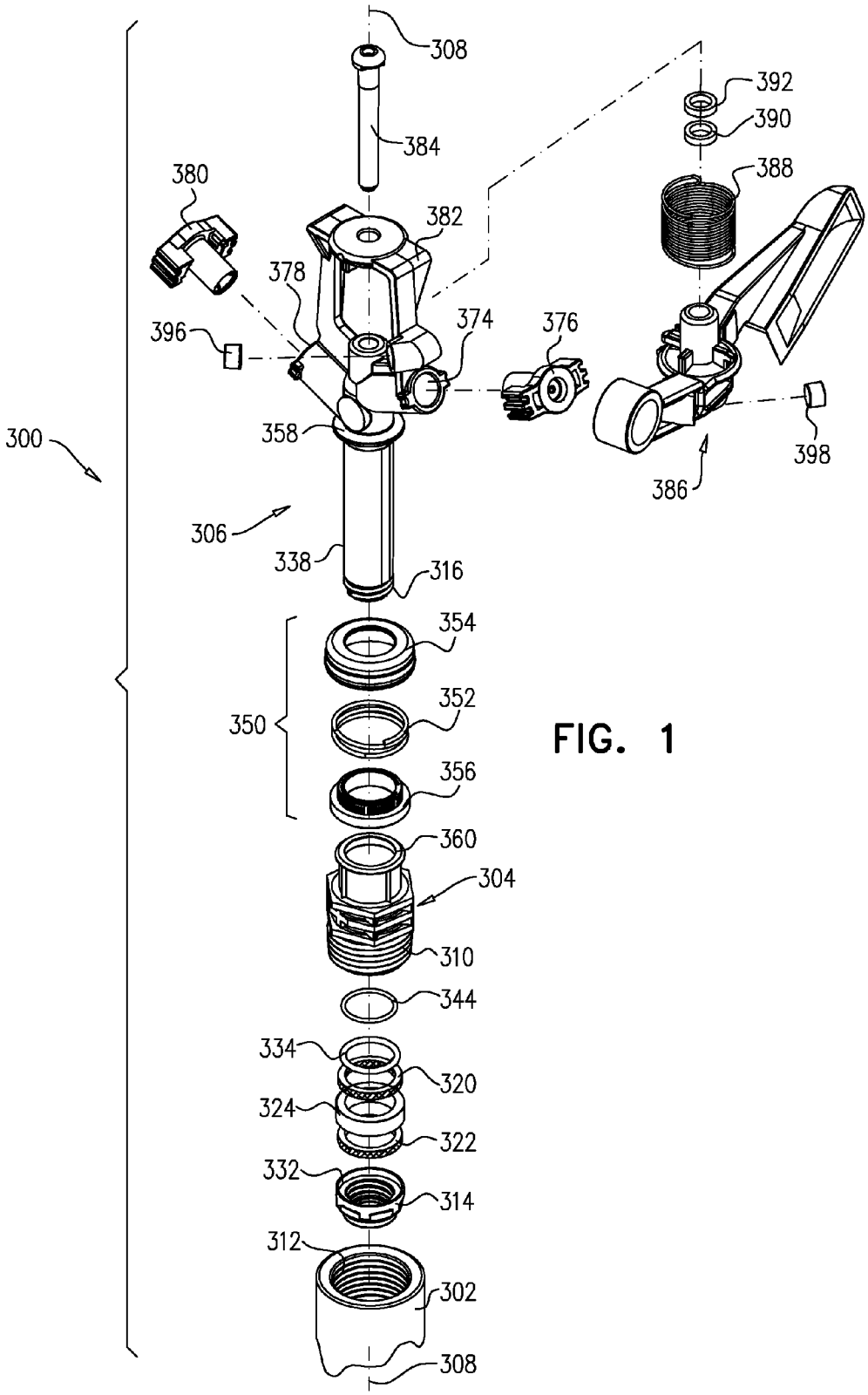
FIG. 1 is a simplified exploded-view illustration of a sprinkler constructed and operative in accordance with a preferred embodiment of the present invention.
Figure 2:
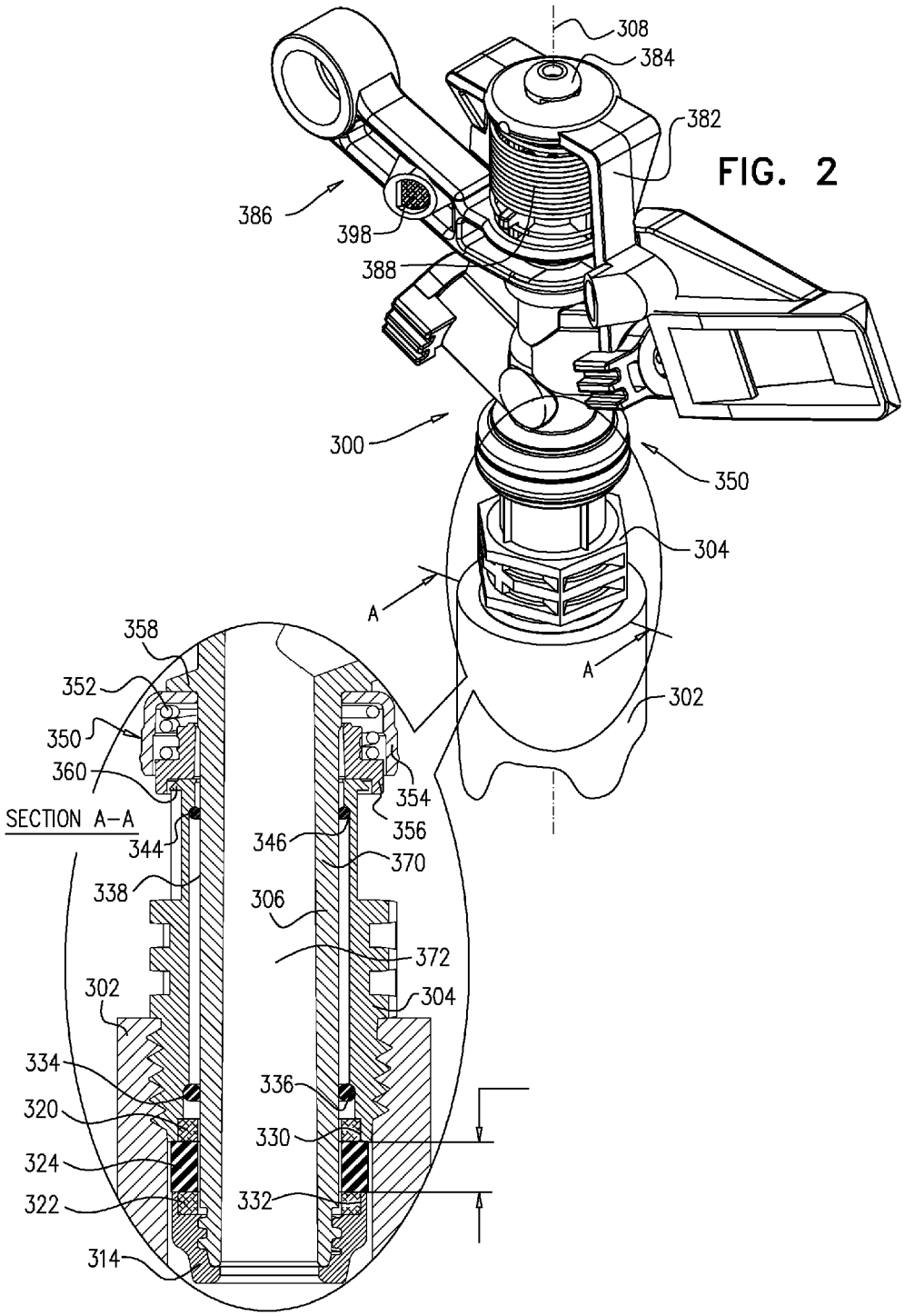
FIG. 2 is a simplified illustration of an assembled sprinkler corresponding to the sprinkler of FIG. 1.
Figure 3A:
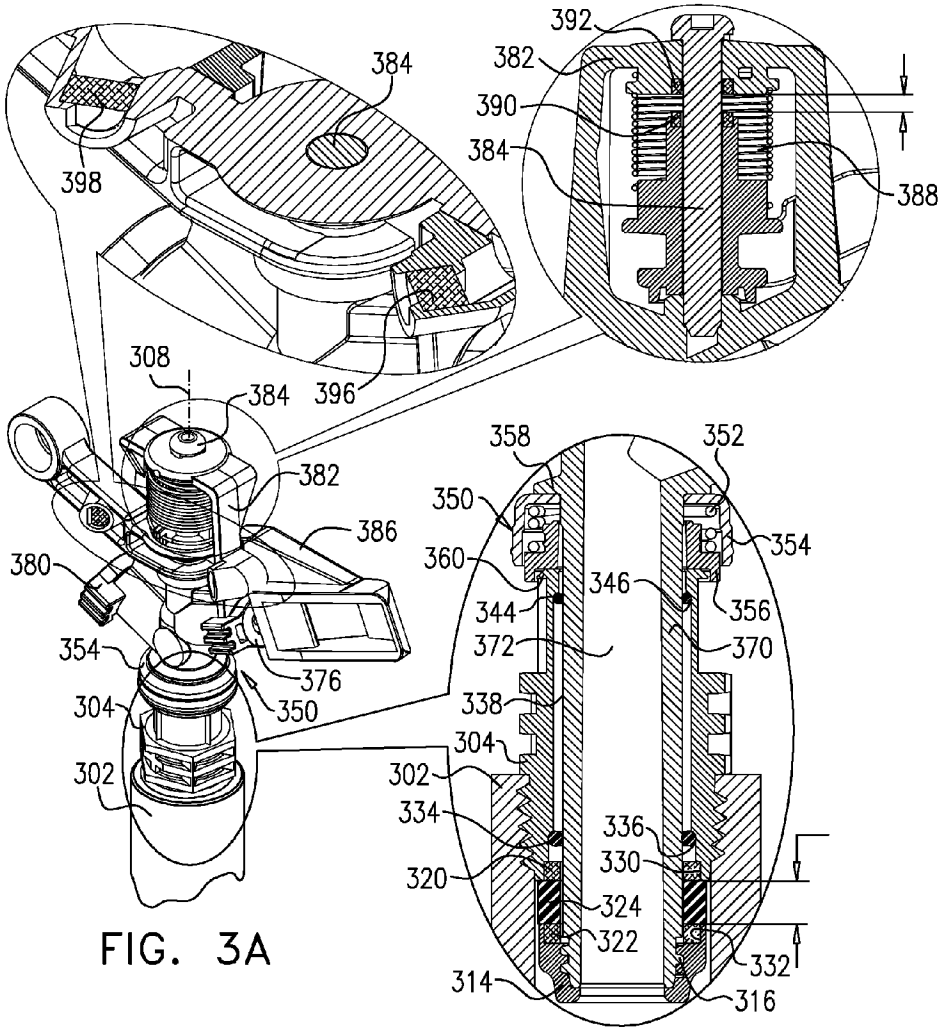
FIG. 3A is a simplified illustration of the sprinkler of FIGS. 1 & 2 in a non-pressurized state.
Figure 3B:
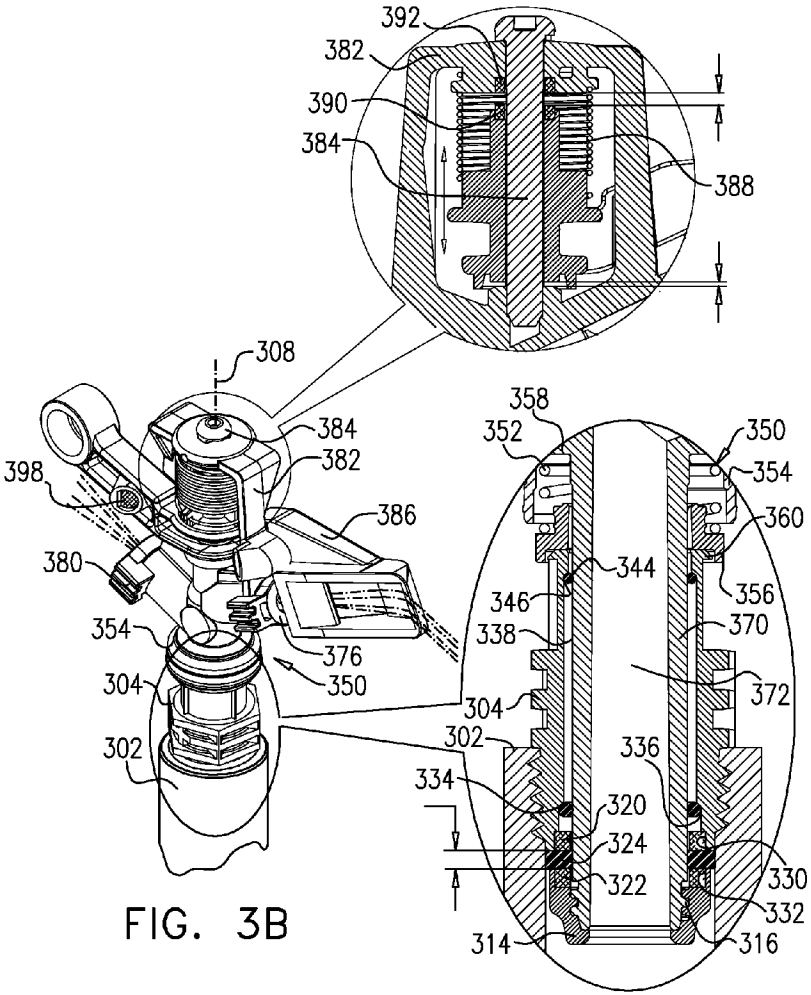
FIGS. 3B and 3C are simplified illustrations of the sprinkler of FIGS. 1 & 2 in respective first and second pressurized states.
Figure 3C:
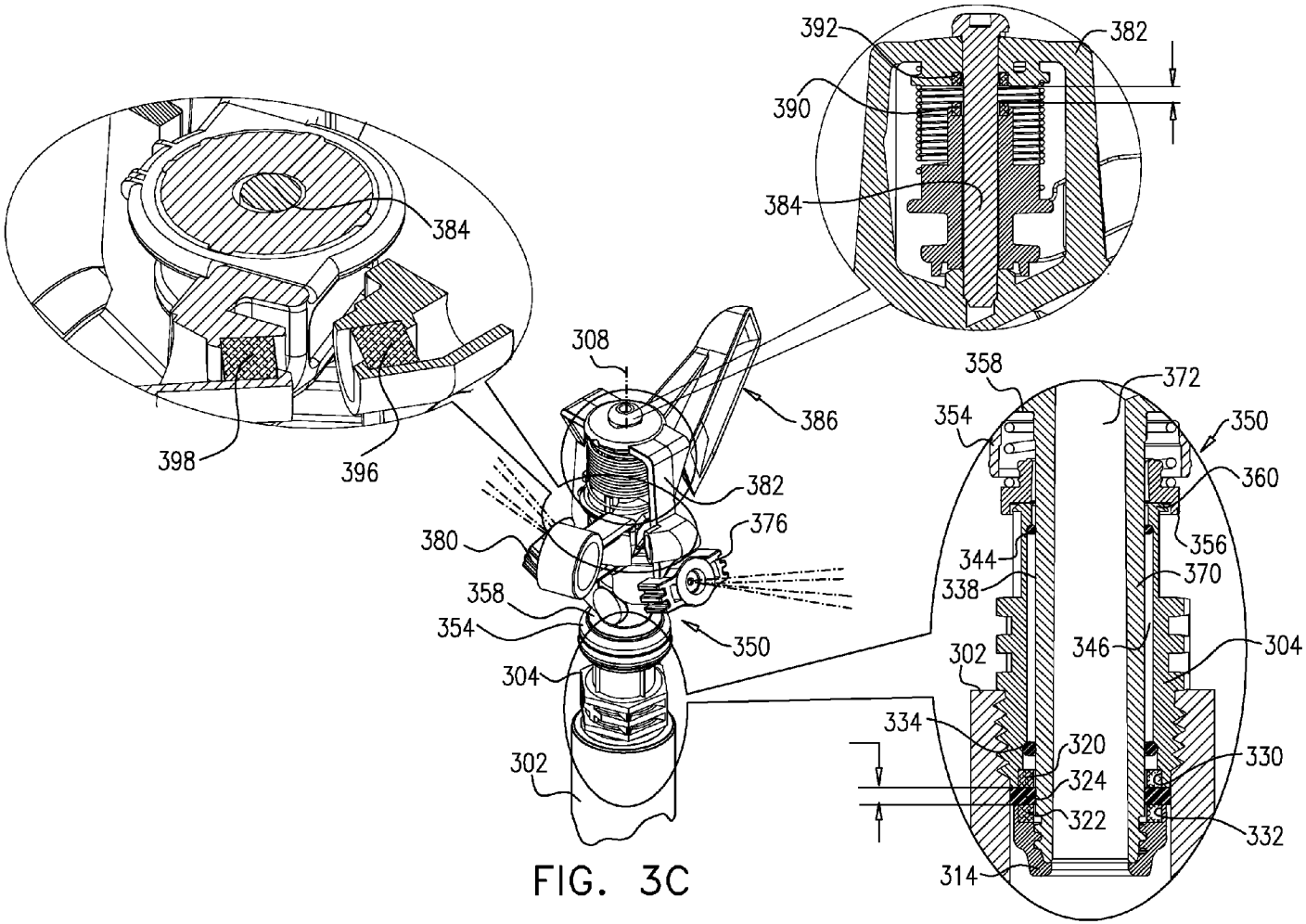

Reference is now made to FIGS. 1 & 2, which are simplified exploded-view and assembled-view illustrations of a sprinkler constructed and operative in accordance with a preferred embodiment of the present invention, and to FIGS. 3A, 3B and 3C, which are simplified illustrations of the sprinkler of FIGS. 1 & 2 in respective non-pressurized and first and second pressurized states.

It is appreciated that the description of FIGS. 1-3C which follows relates to a sprinkler in an upstanding orientation as shown in FIGS. 1-3C and structural terms, such as "top", "bottom", "upper" and "lower", which are incorporated in the descriptors of elements of the sprinkler and directional terms such as "raise" and "lower", which are used to describe axial displacements of parts of the sprinkler are to be understood in this context.

As seen in FIGS. 1-3C, there is provided a sprinkler 300 which is threadably mounted onto a riser 302. Sprinkler 300 includes a base portion 304 and a body portion 306. Riser 302 defines a vertical axis 308. Base portion 304 is normally threadably fixed to riser 302 by threaded engagement of outer threading 310 on base portion 304 and corresponding inner threading 312 of riser 302. Body portion 306 is vertically raisable with respect to the base portion 304 and riser 302 along axis 308, in response to pressurization of sprinkler 300, as shown in FIGS. 3B and 3C.

A nut 314 is threadably engaged with outer threading 316 on the bottom of body portion 306 and serves to slidably retain body portion 306 onto base portion 304, such that body portion 306 may be raised relative to base portion 304 along axis 308 when the sprinkler is pressurized and may be lowered relative to base portion 304 along axis 308 when the sprinkler is depressurized.

First and second respectively oppositely magnetized ring magnets 320 and 322 are separated by a resilient washer 324 and together act as a spring which provides an axial force along axis 308 which resists raising of the body portion 306 relative to base portion 304. Resilient washer 324 acts to provide a seal against particulate contamination and may be obviated. Ring magnet 320 is preferably seated in a corresponding annular recess 330 in base portion 304 and ring magnet 322 is preferably seated in a corresponding annular recess 332 in nut 314.

An o-ring 334 is seated in a recess 336 formed in base portion 304 and lies along an outer cylindrical surface 338 of body portion 306. An o-ring 344 is seated in a recess 346 formed in base portion 304 and lies along outer cylindrical surface 338 of body portion 306 at a location vertically spaced from the location of o-ring 334. O-rings 334 and 344 provide sealing against entry of contaminants as well as frictional engagement between base portion 304 and body portion 306.

A spring assembly 350 including a compression spring 352, an upper spring seat 354 and a lower spring seat 356, is located between a flange 358 of body portion 306 and a flange 360 at the upper end of base portion 304. Alternatively, spring assembly 350 may be obviated.

Body portion 306 is preferably integrally formed of plastic by injection molding and includes a hollow cylindrical portion 370 defining a water passageway 372 whose outer surface is designated by reference numeral 338. Above flange 358, the water passageway is bifurcated into a first outlet passageway 374, with which is associated a nozzle element 376, and a second outlet passageway 378, with which is associated a nozzle element 380.

Above first and second outlet passageways 374 and 378 is formed a pivotable hammer support bridge portion 382 which fixedly retains a pin 384 along axis 308. Pivotably mounted on pin 384 for reciprocating pivotal motion about axis 308 is a water flow deflector and hammer element 386. The reciprocating motion of element 386 is provided with the assistance of a coil spring 388. A pair of oppositely magnetized, mutually repelling magnets 390 and 392 is preferably provided stacked along axis 308 to reduce frictional engagement between element 386 and a surface of bridge portion 382 which overlies element 386 along axis 308.

In accordance with a preferred embodiment of the present invention, oppositely magnetized and mutually repelling magnets 396 and 398 are mounted respectively on body portion 306 and element 386, so as to prevent, in most cases, physical impact between element 386 and bridge portion 382 at an extreme point in the reciprocating rotation of element 386 about axis 308.

Reference is now made to FIGS. 3A, 3B and 3C, which illustrate the operation of the sprinkler of FIGS. 1 and 2 in accordance with a preferred embodiment of the present invention.

FIG. 3A illustrates the sprinkler 300 in an unpressurized state wherein body portion 306 is in a relative lowered position along axis 308 responsive, inter alia, to the mutual repulsion of magnets 320 and 322, which are in a relatively spaced mutual orientation. Spring 352 is in a relative compressed state and spring 388 is in a relative uncompressed state. Magnets 390 and 392 are in a relatively spaced mutual orientation due to their mutual repulsion. Magnets 396 and 398 are relatively spaced from each other, responsive to urging of spring 388, to a degree that practically they do not exert force on each other.

FIG. 3B illustrates the sprinkler 300 in a pressurized state at an instant that water is flowing out through nozzle element 376 into engagement with a deflector portion of element 386. Pressurized engagement of water with body portion 306 causes body portion 306 to rise along axis 308 relative to base portion 304, against the urging of mutually repelling magnets 320 and 322, which are thereby brought into greater axial propinquity, as illustrated. Typically, pressurized engagement of water from nozzle element 376 with the deflector portion of element 386 causes element 386 to be raised along axis 308 relative to body portion 306, against the urging of mutually repelling magnets 390 and 392, which are thereby brought into greater axial propinquity, as illustrated. Magnets 396 and 398 are shown to be relatively spaced from each other, responsive to urging of spring 388, to a degree that practically they do not exert force on each other.

FIG. 3C illustrates the sprinkler 300 in a pressurized state at an instant that water is flowing out through nozzle element 376 but not into engagement with a deflector portion of element 386, due to rotation of element 386 to the opposite extreme of its reciprocating rotation about axis 308, as shown. Pressurized engagement of water with body portion 306 continues to cause body portion 306 to rise along axis 308 relative to base portion 304, against the urging of mutually repelling magnets 320 and 322, which remain in their state of relatively greater axial propinquity, as illustrated. Since pressurized engagement of water from nozzle element 376 with the deflector portion of element 386 no longer takes place, element 386 is no longer raised along axis 308 relative to body portion 306 and is lowered, inter alia, by the urging of mutually repelling magnets 390 and 392. Magnets 396 and 398 are shown to be relatively close to each other and are mutually repelled to a relatively great degree due to their propinquity. This repulsion effectively prevents most impacts between element 386 and bridge portion 382 of body portion 306.

It is appreciated that preferably all three pairs of mutually repelling magnets 320 & 322, 390 & 392 and 396 & 398 are provided, however the present invention includes embodiments wherein only one or two pairs of the mutually repelling magnets are provided.

It will be appreciated by persons skilled in the art that the present invention is not limited by what has been particularly shown and described hereinabove. Rather the scope of the present invention includes both combinations and subcombinations of the various features described hereinabove as well as modifications and variations thereof which are not in the prior art.

The invention claimed is:

1. A sprinkler comprising:

a first portion;

a second portion arranged to rotate in reciprocating motion in a plane about a vertical axis relative to said first portion, responsive to impingement of a water stream on said second portion;

at least a first magnet associated with said first portion; and at least a second magnet associated with said second portion, said first and second magnets being magnetized to repel each other when in at least predetermined propinquity during azimuthal rotation of said second portion relative to said first portion in said plane, said magnets limiting said azimuthal rotation of said second portion relative to said first portion.

2. A sprinkler according to claim 1 and also comprising a spring and wherein said impingement of said water stream on said second portion drives said second portion to rotate in a first direction about said vertical axis relative to said first portion, said spring is operative to urge rotation of said second portion in a second direction about said vertical axis and said first and second magnets cooperate to at least limit impact of said second portion at the end of its rotation in said first direction.

3. A sprinkler according to claim 1 and also comprising a third portion and wherein said first portion is rotatable relative to said third portion.

4. A sprinkler according to claim 1 and wherein said first portion comprises a water outlet arranged to provide said water stream.

5. A sprinkler according to claim 1 and wherein said second portion includes a water stream deflector.

6. A sprinkler according to claim 1 and wherein said first portion is a non-fixed portion.

* * * * *